United States Patent [19]

Bean

[11] 4,045,219

[45] Aug. 30, 1977

[54] METHOD OF REPRODUCING COLOR HIGHLIGHTED DOCUMENTS

[75] Inventor: Lloyd F. Bean, Rochester, N.Y.

[73] Assignee: Xerox Corporation, Stamford, Conn.

[21] Appl. No.: 647,288

[22] Filed: Jan. 7, 1976

[51] Int. Cl.[2] ..... G03G 5/12; G03G 13/01

[52] U.S. Cl. ..... 96/1.2; 96/1 R; 96/1.4; 355/4

[58] Field of Search ..... 96/1 R, 1.2, 1.4; 355/4

[56] References Cited

U.S. PATENT DOCUMENTS

| | | | |
|---|---|---|---|
| 3,615,392 | 10/1971 | Honjo | 96/1.2 |
| 3,615,395 | 10/1971 | Yamaji et al. | 96/1 R X |
| 3,692,519 | 9/1972 | Takahashi | 96/1.2 |
| 3,832,170 | 8/1974 | Nagamatsu et al. | 96/1.2 |
| 3,884,686 | 5/1975 | Bean | 96/1.2 X |
| 3,904,406 | 9/1975 | Takahashi | 96/1.2 X |

*Primary Examiner*—Edward C. Kimlin

*Attorney, Agent, or Firm*—J. J. Ralabate; C. A. Green; H. Fleischer

[57] ABSTRACT

A method of reproducing a color highlighted original document in which at least two successive latent images are recorded on an overcoated photoconductive surface. One of the latent images corresponds to the black regions of the original document, while the other latent image corresponds to one of the color regions of the original document.

5 Claims, 14 Drawing Figures

METHOD OF REPRODUCING COLOR HIGHLIGHTED DOCUMENTS

BACKGROUND OF THE INVENTION

This invention relates generally to color electrophotographic printing, and more particularly concerns a technique of reproducing an original document having color highlights therein.

In a typical electrophotographic printing machine, a light image of an original document is projected onto the charged portion of the photoconductive member to record an electrostatic latent image thereon. The latent image is developed with toner particles to form a toner powder image. Thereafter, the toner powder image is transferred to a sheet of support material. Subsequently, the toner powder image is affixed permanently to the sheet of support material forming a permanent copy of the original document.

Multi-color printing repeats the foregoing process a plurality of cycles. For example, U.S. Pat. No. 3,531,195 issued to Tanaka et al. in 1970, discloses a multi-color electrophotographic printing machine. As recited therein, the light image is filtered to record an electrostatic latent image on the photoconductive surface corresponding to a single color of the original document. This latent image is developed with appropriately colored toner particles. The toner powder image is then transferred to the sheet of support material. The foregoing process is repeated for successive differently colored light images, each latent image being developed with differently colored toner particles. In this manner, a multi-layered toner powder image is formed. The toner powder images may be fused individually onto the sheet of support material, or after all have been transferred thereto. However, in this type of process, black is formed by a combination of all of toner particles rather than being an independent color. This problem was at least partially resolved in U.S. Pat. No. 3,869,203 issued to Lehmann in 1975. As described therein, the copying machine may operate in one of two modes. In the black and white copying mode, black toner particles are employed to render the latent image visible. Contrawise, in the color copying mode, color copies are created through the combination of cyan and red toner particles. However, it should be noted that even in this type of printing machine a process black i.e., resulting from equal densities of cyan and red toner particles is formed in the color copying mode. Thus, this type of printing machine may either reproduce an original document all in black, or in different colors wherein the resultant black contained within the original document is formed by the process of combining cyan and red.

Process blacks frequently are expensive to create, as two rather costly color toners are required to create this rather inexpensive color. In addition, process blacks frequently have objectionable haloes around the characters due to the misregistration of successive images. Hence, that electrophotographic printing machines herein before developed were limited in their capabilities, in that color copies could not be readily formed with both black toner particles and colored toner particles being deposited on a common copy sheet.

Accordingly, it is the primary object of the present invention to improve color highlighting by employing both black and colored toner particles on a common copy sheet.

SUMMARY OF THE INVENTION

Briefly stated, and in accordance with the present invention, there is provided a method of reproducing a color highlighted original document.

This is achieved, in the present instance, by recording a first latent image on an overcoated photoconductive surface. The first latent image corresponds to the black regions of the original document. A second latent image is also recorded on the overcoated photoconductive surface. The second latent image corresponds to one of the color regions of the original document.

BRIEF DESCRIPTION OF THE DRAWINGS

Other objects and advantages of the present invention will become apparent upon reading the following detailed description and upon reference to the drawings, in which.

Figure 1:
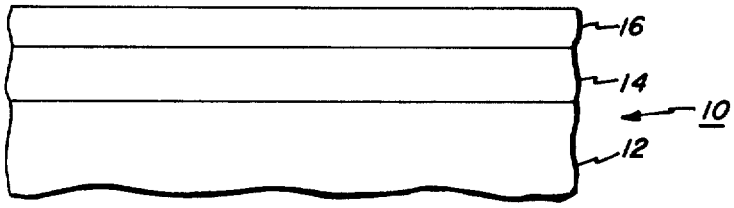
FIG. 1 depicts schematically a fragmentary, sectional, elevational view of a photoconductor employed in the present invention.
Figure 2A:
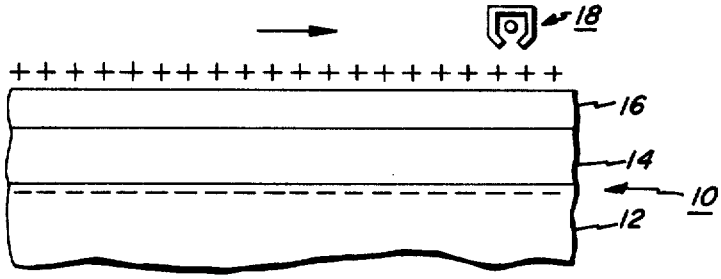
FIG. 2 shows the steps of reproducing the black regions of the original document.
Figure 2B:
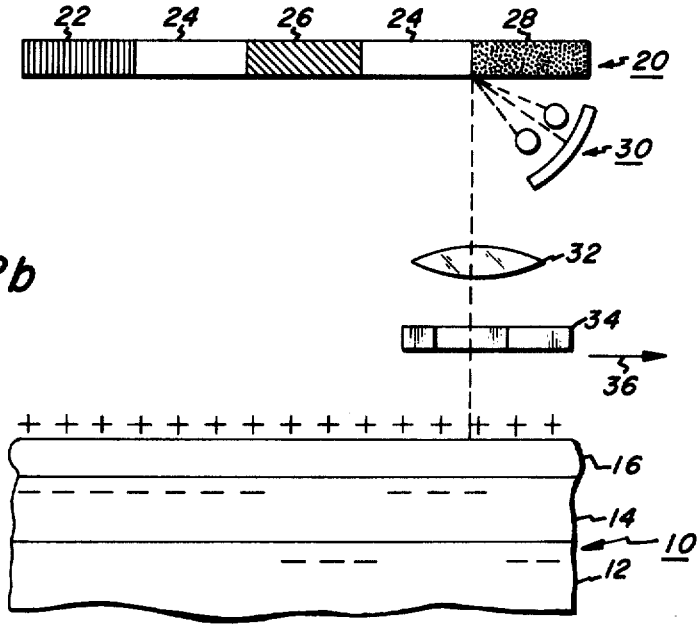
Figure 2C:
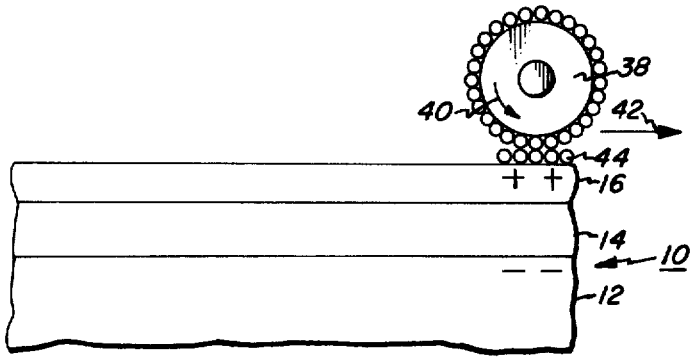
Figure 2D:
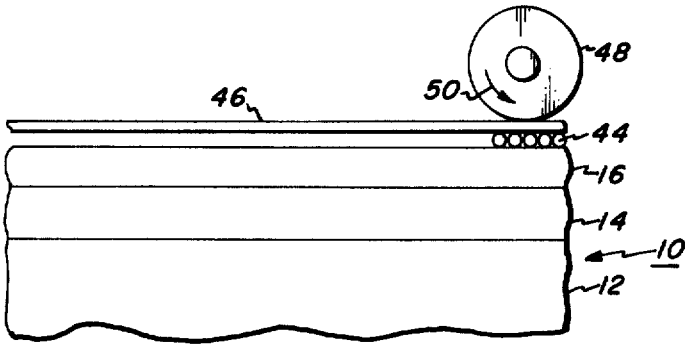
Figure 3A:
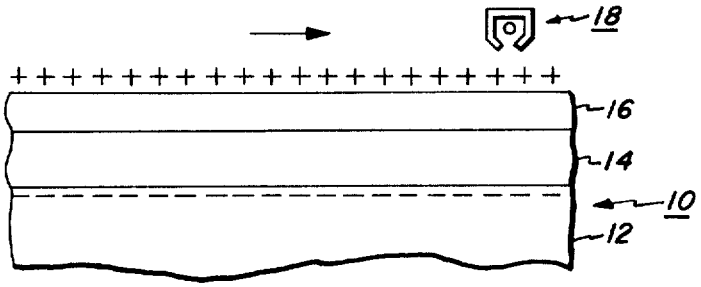
FIG. 3 depicts the steps of reproducing one of the color regions of the original document.
Figure 3B:
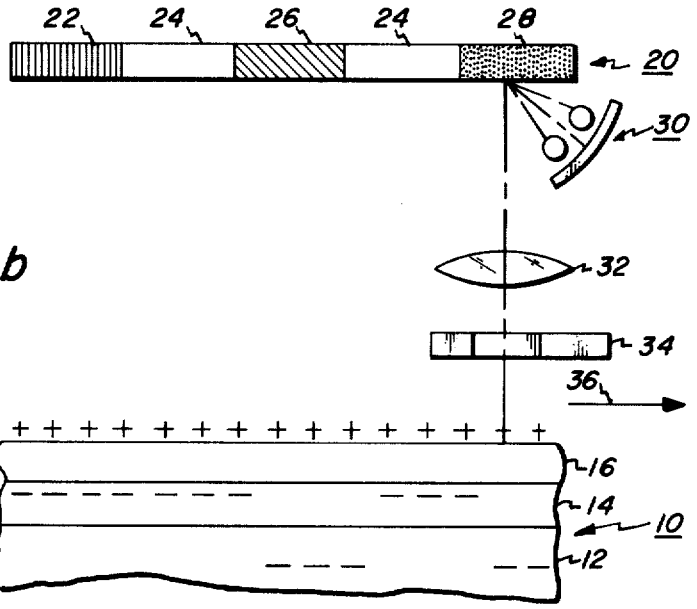
Figure 3C:
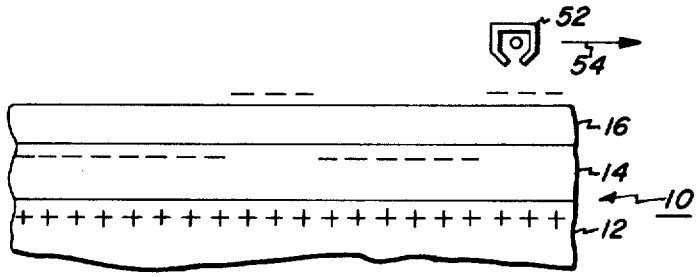
Figure 3D:
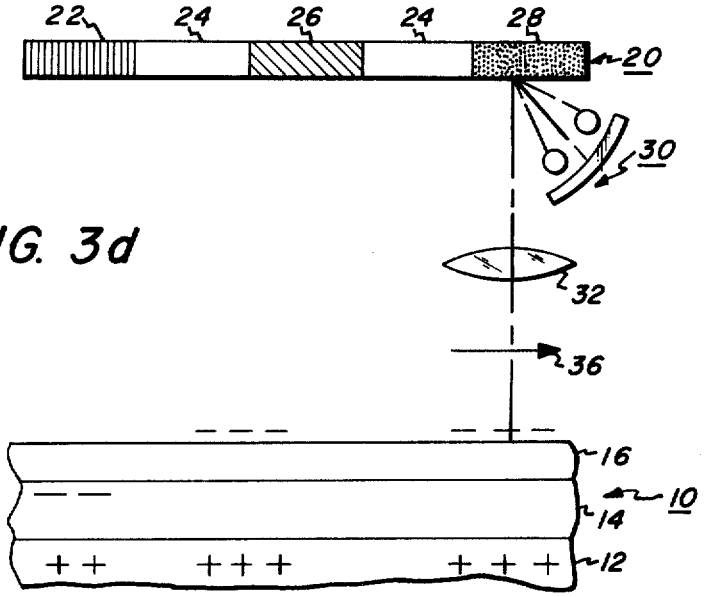
Figure 3E:
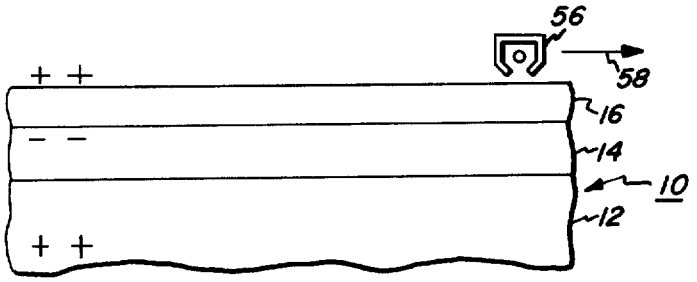
Figure 3F:
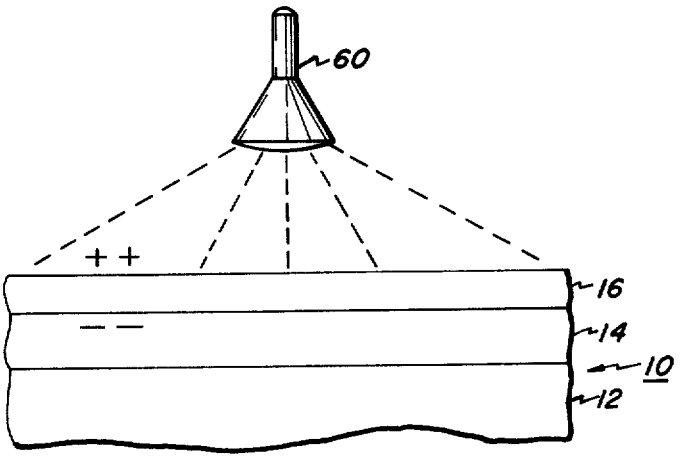
Figure 3G:
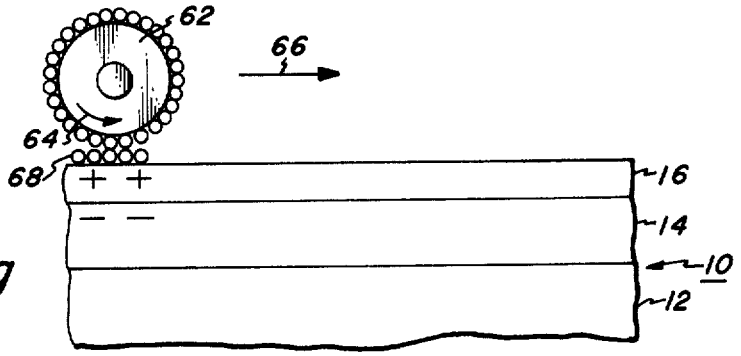
Figure 3H:
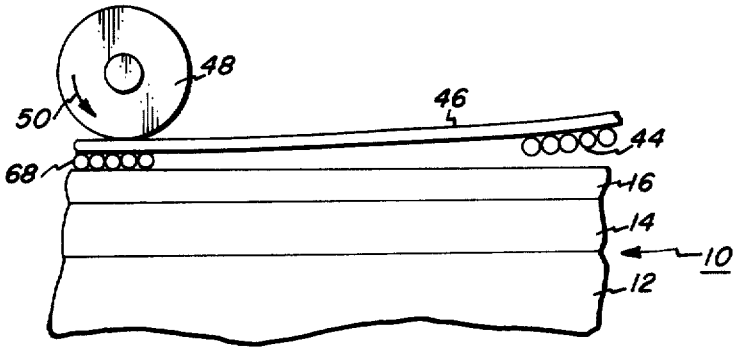

While the present invention will be described in connection with a preferred method of use, it will be understood that it is not intended to limit the invention to that method. On the contrary, it is intended to cover all alternatives, modifications and equivalents as may be included within the spirit and scope of the invention as defined by the appended claims.

DETAILED DESCRIPTION OF THE INVENTION

A general understanding of a method of electrophotographic printing incorporating the steps of the present invention therein may be had by referring to the drawings. In all of the drawings, like reference numerals have been used throughout to designate like elements. The electrophotographic printing process is arranged to reproduce color highlighted original documents. However, one skilled in the art will appreciate that this process is not necessarily limited to that specific application and may be employed to reproduce other types of colored original documents.

The process of electrophotographic printing is well known in the art and will only be discussed hereinafter briefly. Thus, for purposes of the present disclosure, the various processing stations in the printing machine will not be described in detail. However, each of the steps required to reproduce color highlighted original documents will be discussed in conjunction with the drawings.

As shown in FIG. 1, the electrophotographic printing machine includes an overcoated photoconductive member, indicated generally by the reference numeral 10. Preferably, photoconductive member 10 includes a conductive substrate 12, such as aluminum, having a photoconductive surface 14, e.g., a polychromatic selenium alloy, secured thereto. An insulating layer 16, e.g., Mylar, a trademark of duPont, is secured to photoconductive surface 14. Preferably, photoconductive surface 14 is made from the polychromatic selenium alloy described in U.S. Pat. No. 3,655,377 issued to Sechak in 1972.

FIG. 2 illustrates the steps required to reproduce the black portions of the original document on the copy sheet. Referring now to FIG. 2(*a*), photoconductive member 10 is shown thereat. Corona generator 18 charges photoconductive member 10 to a relatively high substantially uniform level. One type of suitable corona generating device is described in U.S. Pat. No. 3,875,407 issued to Hayne in 1975.

Turning now to FIG. 2(*b*), the charged portion of photoconductive member 10 is exposed to a filtered light image of the original document. As shown thereat, original document 20 includes a red region 22, white regions 24, green region 26, and black region 28. Lamp assembly 30 is located beneath original document 22, and, in conjunction with lens system 32 and filter mechanism 34, moves across original document 20, in the direction of arrow 36, to project incremental areas of original document 20 onto the charged portion of photoconductive member 10. Initially, filter mechanism 34, interposes a red filter into the optical light path. This produces the charge distribution depicted in FIG. 2(*b*) on photoconductive member 10. In this way, the red color information has essentially zero density. This step is repeated for green and blue filtered light images, respectively, resulting in a latent image corresponding to the black regions of the original document. The resultant charge distribution on photoconductive member 10 is shown in FIG. 2(*c*). Preferably, filter mechanism 34 is of type described in U.S. Pat. No. 3,775,006 issued to Hartman et al. in 1973. A suitable type of lens is described in U.S. Pat. No. 3,592,531 issued to McCrobie in 1971. Thus, in order to form a latent image corresponding to the black regions of the original document, successive differently colored single color light images are projected onto the charged photoconductive member. The results in a latent corresponding to the black regions of the original document, as illustrated in FIG. 2(*c*).

After the electrostatic latent image corresponding to the black regions of the original document is recorded on photoconductive member 10, this latent image is developed with black toner particles. Preferably, a magnetic brush developer unit 38 is employed. A typical magnetic brush developer unit employs a magnetizable developer mix of carrier granules and toner particles. Developer unit 38 forms a directional flux field to continually create a brush of developer mix. The developer mix is brought into contact with the latent image recorded on photoconductive member 10. Black toner particles 44 adhering electrostatically to the carrier granules of the developer mix are attracted to the latent image, thereby rendering it visible. Developer unit 38 includes a non-magnetic tubular member, preferably made from aluminum, having an irregular or roughened exterior surface. The tubular member is journaled for rotation in the direction of arrow 40 by suitable means such as ball bearings. A shaft, made preferably of steel, is mounted concentrically within the tubular member and serves as a fixed mounting for magnets. Preferably, the magnets are made from barium ferrite in the form of annular rings. Thus, as developer unit 38 moves in the direction of arrow 42, it renders the latent image recorded on photoconductive member 10 visible by depositing black toner particles 44 thereon.

After the latent image recorded on photoconductive member 10 is developed, it is transferred to a copy sheet 46. The foregoing transfer process is depicted in FIG. 2(*d*). Turning now to FIG. 2(*d*), copy sheet 46 is positioned in contact with photoconductive member 10. Transfer roll 48 is electrically biased to a potential of sufficient magnitude and polarity to attract electrostatically toner particles 44 from photoconductive member 10 to copy sheet 46. Transfer roll 48 rotates in the direction of arrow 50. In order to maintain synchronism between successive toner powder images transferred to copy sheet 46, transfer roll 48 rotates at the same tangential velocity as photoconductive member 10 (when photoconductive member 10 is a drum, as in the case of typical electrophotographic printing machines). Thus, successive toner powder images may be transferred from photoconductive member 10 to copy sheet 46. A suitable electrically biased transfer roll is described in U.S. Pat. No. 3,612,677 issued to Langdon et al. in 1971.

In summary, the previous steps illustrate the process of forming a black toner powder image on a copy sheet which corresponds to the black regions of the original document. As hereinbefore described, the photoconductive member is charged to a substantially uniform level. Thereafter, the charged photoconductive member is exposed sequentially to successive differently colored filtered light images. This records a latent image on the photoconductive member corresponding to the black regions of the original document. Thereafter, a magnetic brush system develops the latent image with black toner particles. An electrically biased transfer roll transfers the black toner particles to the copy sheet in image configuration.

Turning now to FIG. 3, the steps required to reproduce the colored portions of the original document will hereinafter be described, i.e., those regions having a color other than black. As shown in FIG. 3(*a*), photoconductive member 10 is charged by corona generating device 18 to a substantially uniform potential having a first polarity (a positive polarity).

Thereafter, original document 20 is exposed to a color filtered light image of the original document. In order to exemplify this process, a red filtered light image will be described. As hereinbefore discussed, original document 20 includes red region 22, white region 24, green region 26 and black region 28. Black region 28 has previously been reproduced on copy sheet 46. Thus, the process hereinafter described will discuss the reproduction of the red and green regions, i.e., regions 22 and 26. This will be exemplified by the reproduction of red region 22. The only distinction between the reproduction of the red region and the green region is in the selection of the color filter and toner particles employed therefor. Hence, in reproducing the red region, a red filter and red toner particles are utilized, whereas in reproducing the green region a green filter and green toner particles are employed. Continuing now with the exposure process, lamps 30, lens 32 and filter mechanism 34 move across original document 20 in the direction of arrow 36. Filter mechanism 34 interposes a red filter into the optical light path. In this manner, the charge distribution depicted in FIG. 3(*b*) is formed on photoconductive member 10. Thus, the color information recorded in the red and white regions have essentially zero density. In this way, the red and white regions will be discharged, whereas the green and black regions will have a charge thereon.

After exposing the charged photoconductive member to a red filtered light image, photoconductive member 10 is re-charged to a second polarity opposed from the first polarity, i.e., a negative polarity. This is achieved by corona generator 52, which is substantially identical to corona generator 18, except that the charge produced thereby is of an opposite polarity. Corona generator 52 moves across photoconductive member 10 in the direction of arrow 54. In this manner, photoconductive member 10 is charged to a polarity opposite that of the first charge. The surface potential is such that the electrical field across insulator 16, in the previously discharged areas, is essentially zero. This results in the charge pattern depicted in FIG. 3(*c*) being formed on photoconductive member 10.

Turning now to FIG. 3(*d*), photoconductive member 10 is exposed to a light image of the original document. The light image is not filtered. Thus, scan lamps 30 once again traverse original document 20 in the direction of arrow 36 to transmit light rays through lens 32 forming a light image of the original document, which is projected onto photoconductive member 10. This exposure neutralizes the interface charge in background areas of the first charge. However, the interface charge is not disturbed in the areas containing the desired color information, i.e., in the red areas. In this way, the charge pattern shown in FIG. 3(*d*) is formed on photoconductive member 10.

Thereafter, photoconductive member 10 is recharged for a third time by an AC corona generating device. This reduces the charge on photoconductive member 10 to zero potential. The charging step results in the electrical field in all of the areas being reduced to a zero potential except the areas having the desired red information. Hence, the surface potential is zero, but there is a voltage across insulating surface 16 and photoconductive surface 14. The foregoing is achieved by moving corona generating device 56 across photoconductive member 10 in the direction of arrow 58. Corona generating device 56 supplies an alternating charge to photoconductive member 10, thereby producing the resultant charge pattern on photoconductive member 10 shown in FIG. 3(*e*).

Finally, photoconductive member 10 is uniformly illuminated by lamp 60. This type of illumination relaxes the electrical field on photoconductive member 10 generating a latent image in the red regions only, as depicted in FIG. 3(*f*).

Thereafter, as shown in FIG. 3(*g*), developer unit 62 which includes a non-magnetic tubular member having magnets mounted interiorly concentrically therein, applies a brush of developer mix to photoconductive member 10. The brush of developer mix includes carrier granules and red toner particles 68. The tubular member of developer unit 62 rotates in the direction of arrow 64 as the developer unit moves across photoconductive member 10 in the direction of arrow 66. It should be noted that developer unit 62 should move away from photoconductive member 10 when the next successive color is being developed. This is required to prevent color mixing. Thus, developer unit 38 is spaced from photoconductive member 10 when developer unit 62 is closely adjacent thereto. A suitable development system for achieving the foregoing is described in U.S. Pat. No. 3,906,987 issued to Davidson in 1975.

Turning now to FIG. 3(*h*), the red toner powder image developed on photoconductive member 10 is transferred to copy sheet 46. As shown thereat, transfer roll 48 is electrically biased to a potential having a suitable magnitude and polarity to attract the red toner particles 68 from photoconductive member 10 to copy sheet 46. As previously noted, copy sheet 46 already has black toner particles 44 transferred thereto. Thus, copy sheet 46 must be positioned on photoconductive member 10 in registration with the previously formed latent images. This may be readily achieved by employing a rotating photoconductive drum in lieu of a flat photoconductive drum and having the transfer roll support the sheet of support material. In this situation, the transfer roll and photoconductive drum rotate in synchronism with one another. Hence, successive toner powder images may be transferred to the copy sheet in registration with one another. The foregoing is more fully described in previously cited U.S. Pat. No. 3,869,203 issued to Lehmann in 1975, the relevant portions thereof being hereby incorporated into the present application.

Thus, the foregoing steps shown in FIGS. 2 and 3 illustrate the reproduction of the red and black regions of the original document on the copy sheet. In order to reproduce the green region, the steps of FIG. 3 are repeated for a green filter and green toner particles. In this situation, the resultant copy sheet has red toner particles 68, green particles 70, and black particles 44 deposited thereon in image configuration. This is shown in FIG. 4.

Figure 4:
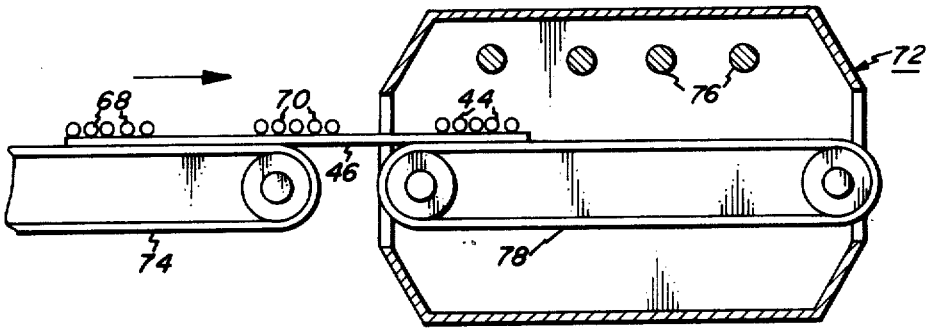
FIG. 4 illustrates the step of fusing the powder images to a sheet of support material.

Referring now to FIG. 4, after the toner powder images have been transferred to copy sheet 46, it advances to fuser 72. Fuser 72 permanently affixes the toner powder images to copy sheet 46. Endless belt conveyor 74 advances copy sheet 46 with red toner powder image 68, green toner powder image 70, and black toner powder image 44 thereon to fuser 72. Fuser 72 includes a plurality of radiant heaters 76 and endless belt 78 for advancing copy sheet 46 therethrough. One type of suitable fuser is described in U.S. Pat. No. 3,826,892 issued to Draugelis in 1974. After the fusing process, copy sheet 46 is advanced by a plurality of endless conveyors (not shown) to a catch tray (not shown) for subsequent removal therefrom by the machine operator. In this manner, a color highlighted copy of the original document is reproduced.

While the present invention has been described in connection with sequentially charging and exposing the photoconductive member, one skilled in the art will appreciate that the invention is not necessarily so limited and that there may be simultaneous charging and exposure for reproducting at least the color regions of the original document.

In recapitulation, it is evident that the electrophotographic printing process heretofore described records a first latent image corresponding to the black regions of the original document thereon. This latent image is subsequently developed with black toner particles, which are thereafter transferred to the copy sheet. Thereupon, the process requires the recordation of a second latent image corresponding to one color of the original document on the photoconductive member. This latent image is then developed with toner particles corresponding in color to the color of the filtered light image. These toner particles are then also transferred to the copy sheet in registration with the black toner particles previously deposited thereon. Finally, the resultant copy having the black and colored regions formed thereon is passed through a fusing device which permanently affixes the toner powder images to the copy sheet. It should be noted that the steps of forming the black latent image may be reversed with the steps of forming the colored latent images. Thus, there is no requirement that the black latent image be formed first, but the colored latent images may be formed, in lieu thereof, initially and the black latent image formed subsequently.

It is, therefore, apparent that there has been provided in accordance with the present invention, a process of electrophotographic printing that fully satisfies the objects, aims and advantages hereinbefore set forth. While the present invention has been described in conjunction with a specific method of use, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A method of reproducing a color highlighted original document, including the steps of:

charging a photoconductive surface having an electrically insulating overcoating to a substantially uniform level;

projecting successive single color light images into the charged portion of the photoconductive surface, in superimposed registration with one another, to record a first electrostatic latent image on the overcoated photoconductive surface;

developing the first latent image recorded on the overcoated photoconductive surface with black particles;

transferring the black particles from the latent image to a sheet of support material;

charging the overcoated photoconductive surface to a substantially uniform level having a first polarity;

projecting a single color light image onto the charged portion of the overcoated photoconductive surface;

charging the portion of the overcoated photoconductive surface having the single color light image projected thereon to a substantially uniform level having a second polarity opposite to the charge of the first polarity;

projecting a light image of the original document onto the charged portion of the overcoated photoconductive surface;

applying an alternating charge to the portion of the overcoated photoconductive surface having the light image of the original document projected thereon;

illuminating uniformly the overcoated photoconductive surface to record a second electrostatic latent image corresponding to one of the colored regions of the original document;

developing the second latent image recorded on the overcoated photoconductive surface with particles corresponding in color to the color of the single color light image; and transferring the colored particles to the sheet of support material having the black particles thereon.

2. A method as recited in claim 1, wherein said step of projecting a single color light image includes the steps of:

illuminating the original document with light rays;

forming a light image of the original document by passing the light rays transmitted from the original document through a lens;

filtering successive light images with differently colored optical light filters to form successive single color light images; and directing successively each single color light image onto the charged portion of the photoconductive surface in registration with one another.

3. A method as recited in claim 2, wherein said step of projecting a light image includes the steps of:

illuminating the original document with light rays;

interposing a lens into the optical light path to form a light image of the original document; and directing the light image onto the charged portion of the overcoated photoconductive surface.

4. A method as recited in claim 1, further including the steps of repeating said steps of charging to a first polarity, projecting a single color light image, charging to a second polarity opposed to the first polarity, projecting a light image, applying an alternating charge, illuminating uniformly, developing, and transferring for a second single color light image of a color different from the first mentioned single color light image.

5. A method as recited in claim 4, further including the step of permanently affixing the particles to the sheet of support material.

* * * * *